US005645455A

United States Patent [19]

Seki

[11] Patent Number: 5,645,455

[45] Date of Patent: Jul. 8, 1997

[54] JOINT CONNECTOR

[75] Inventor: Yoshinobu Seki, Shizuoka-ken, Japan

[73] Assignee: Yazaki Corporation, Tokyo, Japan

[21] Appl. No.: 379,989

[22] Filed: Jan. 27, 1995

[30] Foreign Application Priority Data

Feb. 2, 1994 [JP] Japan ..... 6-10881
Jun. 27, 1994 [JP] Japan ..... 6-144791

[51] Int. Cl.[6] ..... H01R 11/09

[52] U.S. Cl. ..... 439/723; 439/189

[58] Field of Search ..... 439/721, 723, 439/724, 189, 511, 507, 510, 574, 575, 538, 512

[56] References Cited

U.S. PATENT DOCUMENTS

| | | | |
|---|---|---|---|
| 3,548,367 | 12/1970 | Bruetsch | 439/724 |
| 4,054,354 | 10/1977 | Unger | 439/724 |
| 4,983,132 | 1/1991 | Weidler | 439/729 |
| 5,112,239 | 5/1992 | Yagi et al. | 439/189 |
| 5,226,834 | 7/1993 | Kato et al. | 439/358 |

FOREIGN PATENT DOCUMENTS

| | | |
|---|---|---|
| 56-115878 | 9/1981 | Japan . |
| 62-103182 | 7/1987 | Japan . |
| 62-104378 | 7/1987 | Japan . |

*Primary Examiner*—Hien Vu
*Attorney, Agent, or Firm*—Wigman, Cohen, Leitner & Myers, P.C.

[57] ABSTRACT

A joint connector comprises: a connector housing (12) formed with a first joint opening (12A) joined with a first mated connector (17) on a first end side thereof and a second joint opening (12B) joined with a second mated connector (18) on a second end side thereof; and a bus bar (13, 23, 33) housed in the connector housing and formed with a plurality of branch terminal portions (**13*a*, 23*a*, 33*a*) extending symmetrically toward the first and second end sides of the connector housing (12) and arranged also symmetrically when seen from any of the first and second end sides of the connector housing. Further, a plurality of the bus bars (13, 23) are arranged also symmetrically in the connector housing when seen from both the first and second end sides of the connector housing (12**). Therefore, whenever the mated connectors are jointed with the joint connector on either side, it is possible to obtain the same electrical connection conditions.

14 Claims, 14 Drawing Sheets

JOINT CONNECTOR

BACKGROUND OF THE INVENTION

1. Technical Field

The present invention relates to a joint connector, and more specifically to a double-sided joint connector for joining two other mated connectors jointed with both the joint openings formed on both the sides of the joint connector.

2. Description of the Related Art

FIG. 1 shows an example of a related art double-sided joint connector, which is disclosed in Japanese Published Unexamined Utility Model Application No. 56-115878. In FIG. 1, this joint connector 1 is composed of a connector housing 2 having a first (front side) joint opening 2A and a second (rear side) joint opening 2B both joined with two other mated connectors (not shown), respectively, and a plurality of bus bars 3 and 4 housed in the connector housing 2.

In the related art joint connector 1, one bus bar 3 is formed with a single base terminal portion 5 extending frontward from the inside of the connector housing 2 and two branched terminal portions 6 extending rearward from the inside of the connector housing 2. On the other hand, the other bus bar 4 is formed with a single base terminal portion 5 extending frontward from the inside of the connector housing 2 and three branched terminal portions 6 extending rearward from the inside of the connector housing 2. These two bus bars 3 and 4 are housed within the connector housing 2 being arranged side by side horizontally (in the right and left direction) in such a way that the ends of the branch terminal portions 6 are arranged in a line within the rear joint opening 2B of the connector housing 2.

The shapes of these bus bars 3 and 4 are different from each other, and further the arrangement of the terminal portions 5 and 6 of these bus bars 3 and 4 are different from each other when viewed at the front and rear joint openings 2A and 2B. In more detail, when seen from the front joint opening 2A side (in the direction of arrow A in FIG. 1), the base terminal portions 5 are arranged as shown on the lower side in FIG. 2A, and when seen from the rear joint opening side 2B (in the direction of arrow B in FIG. 1), the branch terminal portions 6 are arranged as shown also on the lower side in FIG. 2B. That is, the terminal end portions 5 or 6 are arranged in a different way on both the front and rear joint openings 2A and 2B, respectively. Further, in FIGS. 2A and B, the bus bars 3 and 4 are shown by solid lines, and the respective terminal portions 5 and 6 which can be seen from either side are shown by black squares to facilitate the mutual positional relationship between the base terminal portions 5 and the branch terminal portions 6.

In the related art double-sided joint connector as described above, when a mated connector 7 is inserted into the front joint opening 2A and another mated connector 8 is inserted into the rear joint opening 2B respectively, as shown in FIG. 3, these two mated connectors 7 and 8 can be connected to each other through the double-sided joint connector 1.

Here, FIG. 4A shows a correct connection. Under these conditions, the mated connector 7 is joined to the front joint opening 2A of the joint connector 1 in such a way that a terminal end portion 7*a* of one mated connector 7 is in contact with the base terminal portion 5 of the bus bar 3, and the other mated connector 8 is joined to the rear joint opening 2B of the joint connector 1 in such a way that the branched end portions 6 of the bus bars 3 and 4 are in contact with the terminal end portions 8*a* to 8*e* of the other mated connector 8. Through the above-mentioned connection, since the terminal end portions 8*a* to 8*c* of the mated connector 8 are connected to each other, and in addition since the terminal end portions 8*d* and 8*e* are connected to the terminal end portion 7*a* of the mated connector 7, respectively, it is possible to form a required electric circuit.

In the above-mentioned double-sided joint connector, however, there exists such a possibility that the two mated connectors 7 and 8 are joined to the double-sided joint connector erroneously in the opposite way. When the two mated connectors 7 and 8 are connected to the joint connector 1 correctly, a correct electric circuit as shown in FIG. 4A can be established. However, when connected in the opposite way, it is no longer impossible to form a correct electric circuit, as shown in FIG. 4B. In more detail, when the two mated connectors 7 and 8 are joined to opposite sides of the joint connector 1 erroneously, the terminal end portions 8*a* to 8*c* of the mated connector 8 are not connected to each other, and further the terminal end portions 8*d* and 8*e* of the mated connector 8 are not connected to the terminal end portion 7*a* of the mated connector 7.

SUMMARY OF THE INVENTION

With these problems in mind, therefore, it is the object of the present invention to provide a joint connector which can establish the same electric connections, irrespective of which of the mated connectors are joined to either of the front and rear joint openings of the joint connector, that is, even if the mated connectors are connected to either side of the connector housing of the double-sided joint connector.

To achieve the above-mentioned object, the present invention provides a joint connector, comprising: a connector housing (12) formed with a first joint opening (12A) joined with a first mated connector (17) on a first end side of said connector housing and a second joint opening (12B) joined with a second mated connector (18) on a second end side thereof; and a bus bar (13, 23, 33) housed in said connector housing and formed with a plurality of branch terminal portions (13*a*, 23*a*, 33*a*) extending symmetrically from the first and second end sides of said connector housing (12) and having the same symmetrical arrangement from end side to end side when viewed from either the first or the second end side of said connector housing.

Further, a plurality of said bus bars (13, 23) are arranged also symmetrically in said connector housing when seen from any of the first and second end sides of said connector housing (12). A plurality of said bus bars (13, 23, 33) are arranged in a horizontal plane in said connector housing or in vertically spaced horizontal planes in of said connector housing.

Further, the connector housing (12) preferably comprises a first slide engage portion (110A) engaged with a mounting member (72) for fixing the joint; and a second slide engage portion (110B) engaged with the same mounting member (72) for fixing the joint. The mounting member (72) is a mounting bracket. Further, said first slide engage portion (110A) and said second slide engage portion (110B) are arranged symmetrically on an outer side surface of said connector housing. Here, each of said first slide engage portion (110A) and said second slide engage portion (110B) comprises: a pair of guide rails (112) for guiding the mounting member; a deformable arm (118) formed between said pair of said guide rails and formed with a projection (120) engaged with an engage hole (73) formed in the mounting member (72); and a stopper wall (126) formed inside of said guide rails to limit insertion of the mounting member into said slide engage portion. Further, it is preferable that a pair of said guide rails (112) of said first slide engage portion (110A) and a pair of said guide rails (112) of said second slide engage portion (110B) are formed integral with each other. Further, it is preferable that the engage projection (120) of said first slide engage portion (110A) and the engage projection (120) of said second slide engage portion (110B) are arranged transversely offset from each other when seen from the first and second end sides of said connector housing. Further, deformable arm (118) is formed with a sloped portion (127) for deflecting said arm when the mounting member (72) is slid into the slide engage portion (110A, 110B).

In the joint connector according to the present invention, since the arrangement of the branched terminal portions (including the electric connection paths) can be made identical on both sides of the first and second joint openings of the connector housing, even if any of the two mated connectors is connected to any one of the joint openings of the joint connector, it is possible to obtain the same electrical connection conditions. Accordingly, any problem caused by erroneous connection of the mated connectors to the joint connector can be eliminated. Further, since the same mated connectors can be connected to any one of the joint openings of the joint connector, the mated connectors can be standardized, so that the cost thereof can be reduced. In addition, since the branched terminal portions of the bus bar are formed symmetrically at both the first and second joint opening sides of the joint connector and further have the same symmetrical arrangement when seen from any of the first and second joint opening sides of the connector housing, when the bus bars are insertion-molded together with the connector housing, the shrinkage and the distortion of the resin is uniform, so that the positional precision of the branched terminal portions can be improved.

Further, in the joint connector according to the present invention, since the connector housing can be engaged with the mounting member on either side of the first and second joint openings of the joint connector, the mated connectors can be connected to the joint connector from any side of the connector housing, without taking into account the direction of the connector housing of the joint connector relative to the direction of the mounting member.

BRIEF DESCRIPTION OF THE DRAWINGS

FIGS. 2A and B are views showing the arrangement of the bus bars and the terminal portions of the prior art joint connector shown in FIG. 1, in which FIG. 2A is a view when seen in an arrow direction A and FIG. 2B is a view when seen in an arrow direction B both shown in FIG. 1;

FIGS. 12A to D are illustrative plan views of the joint connector showing the arrangement of the bus bar and the branched terminal portions of still other embodiments, in which FIG. 12A shows an example where two 6-pin bus bars are arranged on each of the upper and lower sides of the connector housing; FIG. 12B shows an example where two 6-pin bus bars are arranged on the upper side and three 4-pin bus bars are arranged on the lower side of the connector housing; FIG. 12C shows an example where one 12-pin bus bar is arranged on each of the upper and lower sides of the connector housing; and FIG. 12D shows an example where one 12-pin bus bar is arranged on the upper side and two 6-pin bus bars are arranged on the lower side of the connector housing;

DETAILED DESCRIPTION OF THE EMBODIMENTS

An embodiment of the joint connector according to the present invention will be described hereinbelow with reference to the attached drawings.

With reference to FIGS. 5 to 8, a joint connector 11 having 12 poles on one (front or rear) side and 24 poles on both (front and rear) sides is composed a connector housing 12 and six bus bars 13. The connector housing 12 is formed with a first (front side) joint opening 12A, a second (rear side) joint opening 12B, and a middle partition wall 12C. The six bus bars 13 are all housed in this connector housing 12 and fixed to the partition wall 12C, respectively at each middle thereof.

Figure 1:
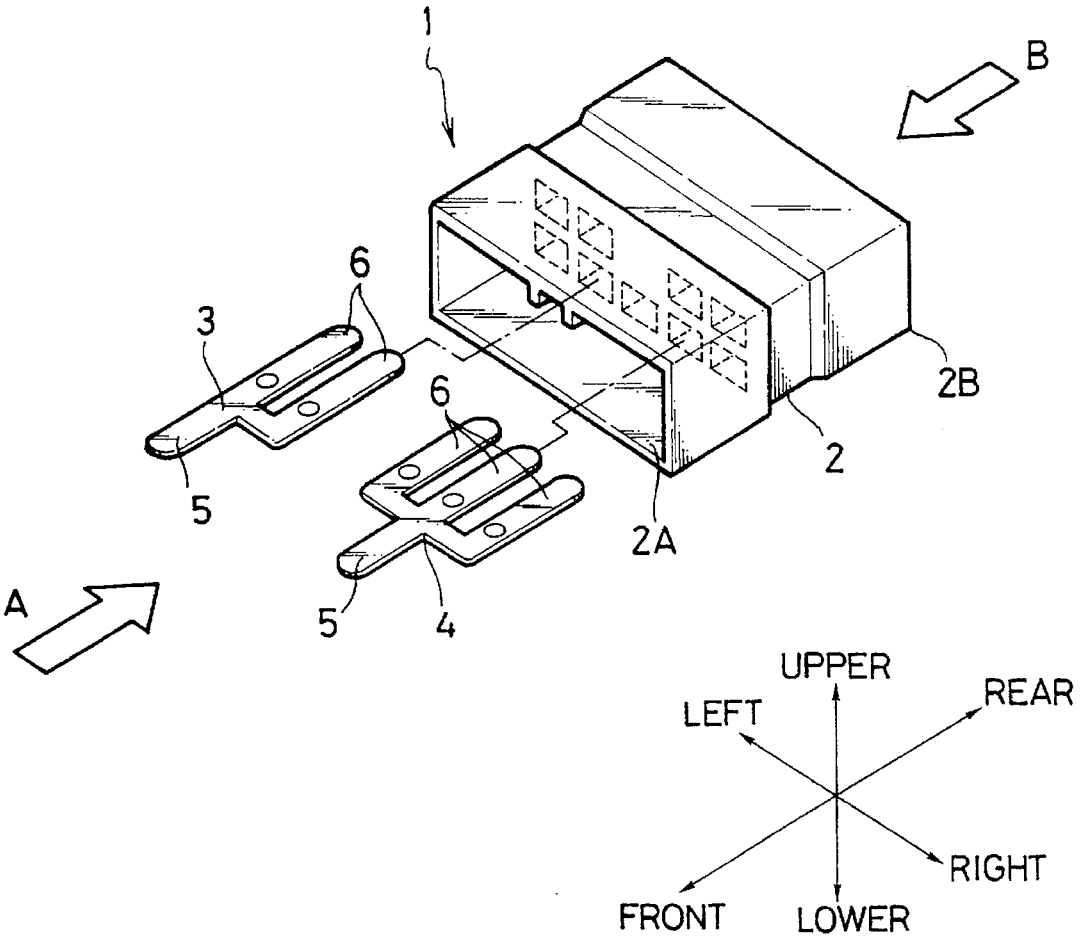
FIG. 1 PRIOR ART
FIG. 1 is a perspective view showing a prior art double-sided joint connector.
Figure 2A:
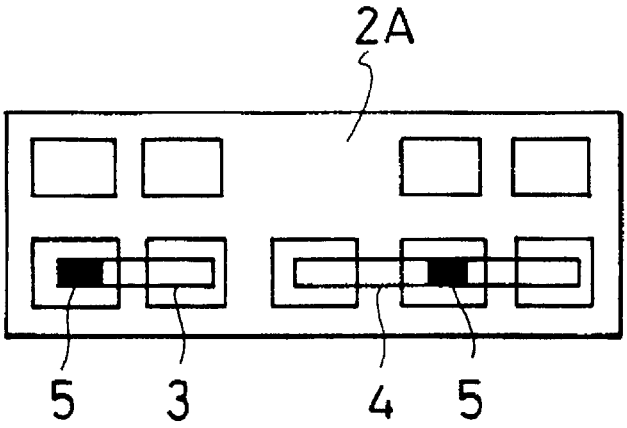
FIG. 2A PRIOR ART
Figure 2B:
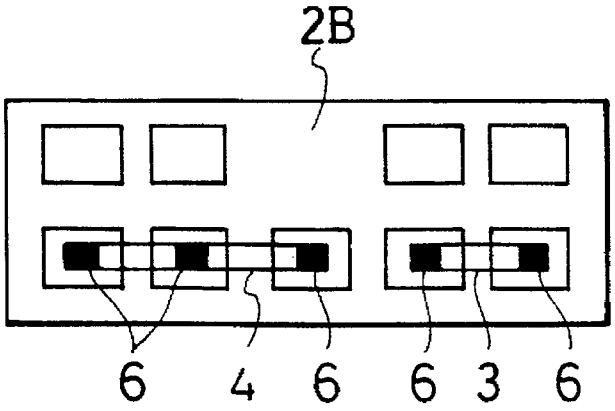
FIG. 2B PRIOR ART
Figure 3:
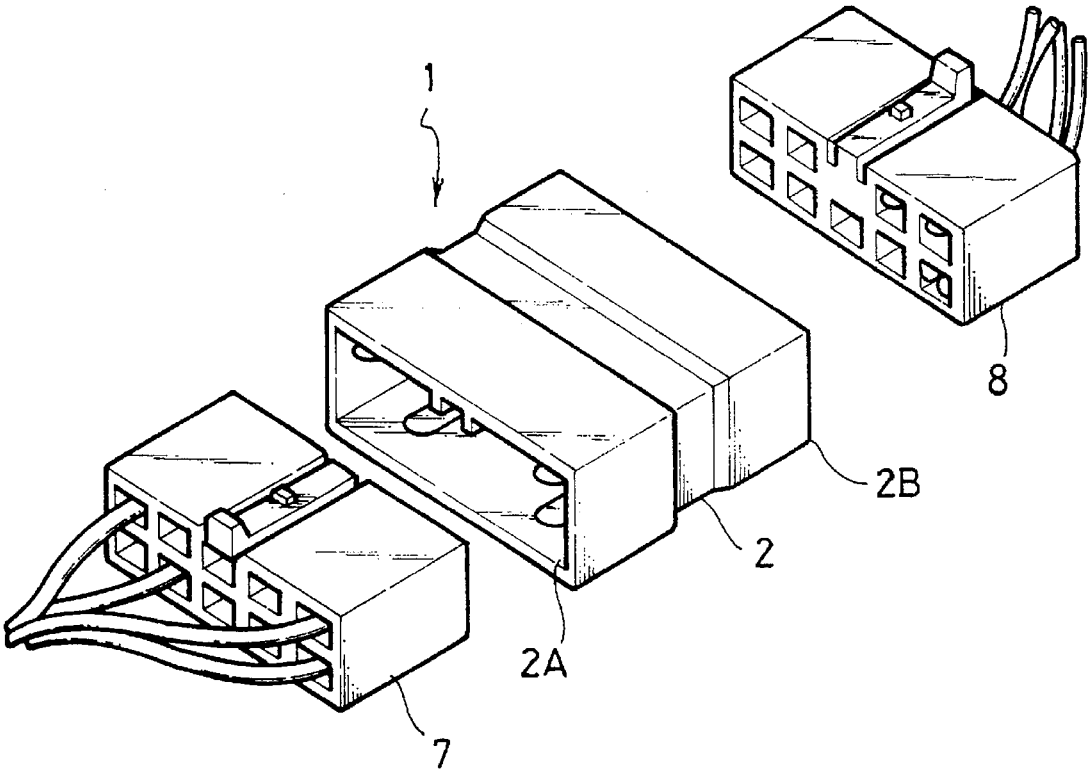
FIG. 3 PRIOR ART
FIG. 3 is a perspective view showing two other mated connectors to be joined with the prior art joint connector shown in FIG. 1.
Figure 4A:
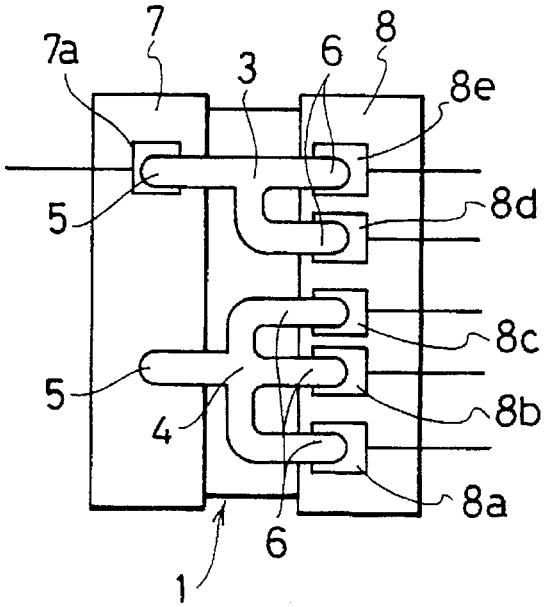
FIG. 4A PRIOR ART
FIG. 4A is an illustrative plan view showing the electrical connection between the two mated connectors and the prior art joint connector when connected correctly.
Figure 4B:
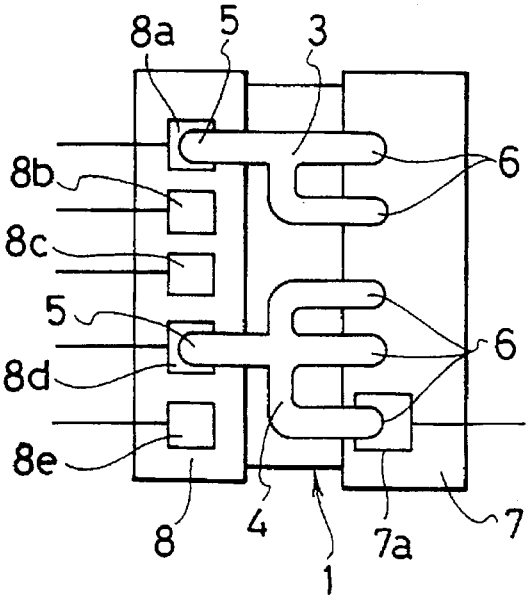
FIG. 4B PRIOR ART
FIG. 4B is an illustrative plan view showing the electrical connection between the two mated connectors and the prior art joint connector when connected erroneously.
Figure 5:
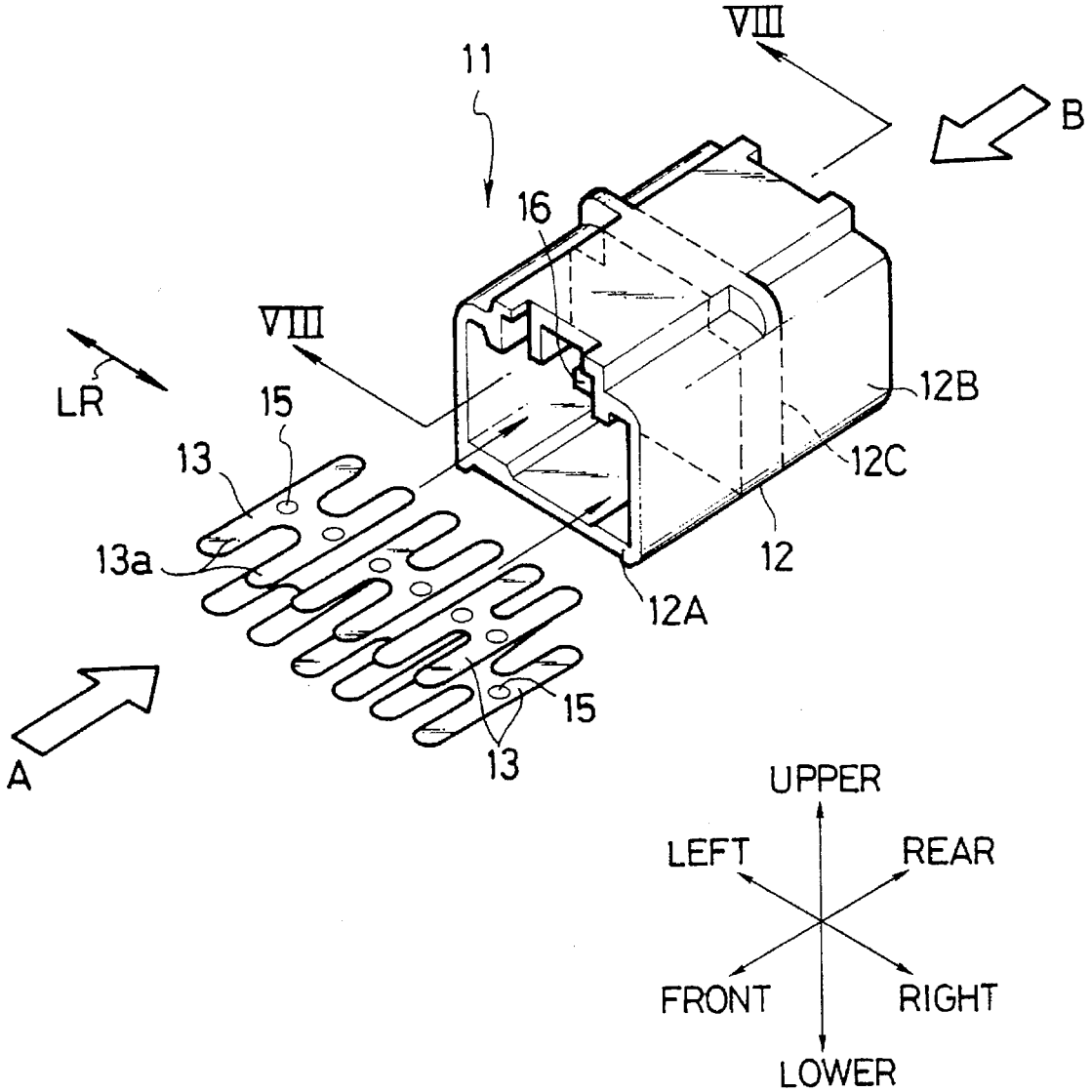
FIG. 5 is a perspective view showing an embodiment of the joint connector according to the present invention.
Figure 6:
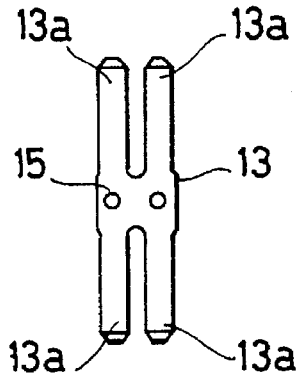
FIG. 6 is a plan view showing a bus bar used for the first embodiment shown in FIG. 5.
Figure 7:
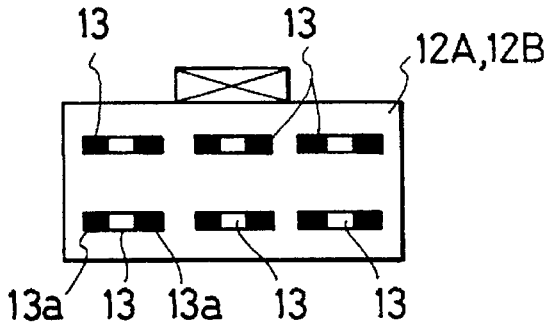
FIG. 7 is an illustrative plan view of the joint connector showing the arrangement of the bus bar and the branched terminal portions of the first embodiment.

The six bus bars 13 are arranged upper in and lower portions of the housing 12 in two groups of three bus bars each, with the groups being positioned in vertically spaced horizontal planes. Further, as shown in FIG. 6, each bus bar 13 is formed with four branch terminal portions 13*a* extending two by two in both the front and rear directions of the connector housing 12. Therefore, when seen from the front side of the housing 12 in an arrow direction A and from the rear side of the housing 12 in an arrow direction B both shown in FIG. 5, the arrangement of the branch terminal portions 13*a* of the bus bar 13 is the same in both as shown in FIG. 7, so that the electrical connection obtained when the mated connectors are joined to the joint connector 11 is the same in both sides.

Figure 8:
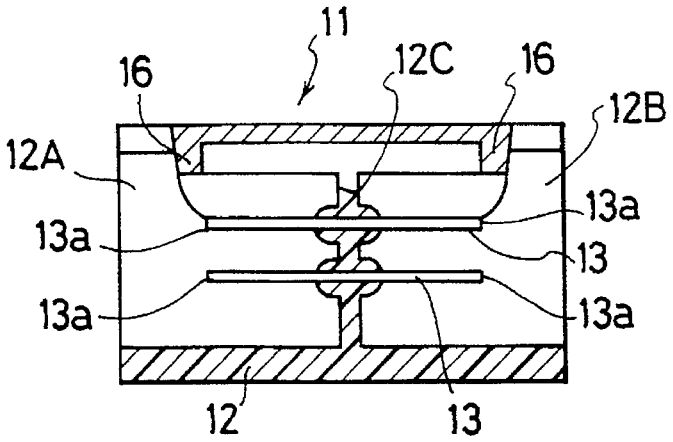
FIG. 8 is a cross-sectional view taken along the line VIII—VIII in FIG. 5.

Further, after having been arranged in a molding die, these bus bars 13 are insertion-molded together with the connector housing 12, so that the bus bars 13 can be fixed to the connector housing 12 at predetermined positions. In order to increase the fixing force to the connector housing 12, each bus bar 13 is formed with two holes 15 at each base portion of the branch terminal portion 13*a*, that is, at the middle portion of the bus bar 13. In this case, it is also possible to form two projections instead of the holes 15. Further, without insertion-molding the bus bars 13, it is possible to insert the bus bars 13 into an already-molded connector housing 12 and to fix these bus bars 13 to the connector housing 12 by use of any appropriate fixing means. Further, as shown in FIG. 8, the connector housing 11 is formed with an inner guide portion and a lock portion 16 for guiding and locking a mated connector.

Figure 9:
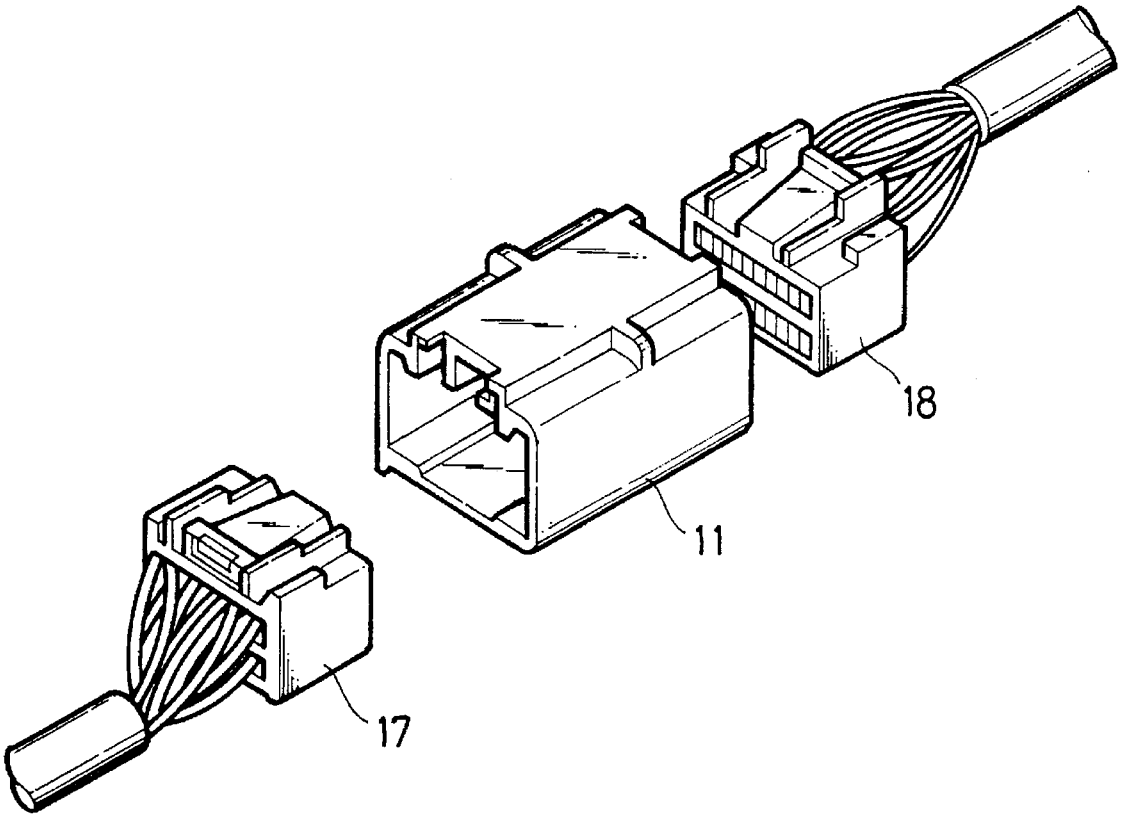
FIG. 9 is a perspective view showing two other mated connectors to be joined with the joint connector of the embodiment shown in FIG. 5.
Figure 10A:
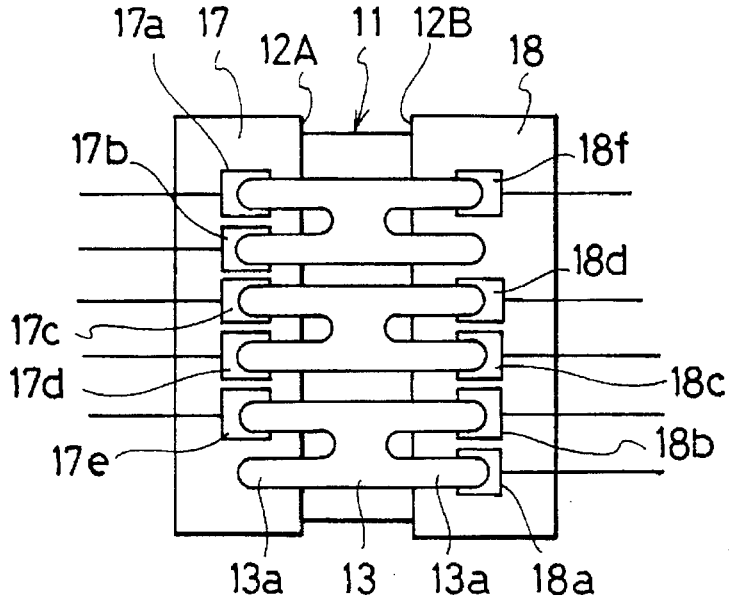
FIG. 10A is an illustrative plan view showing the electrical connection between the two mated connectors and the joint connector of the present invention when connected correctly.
Figure 10B:
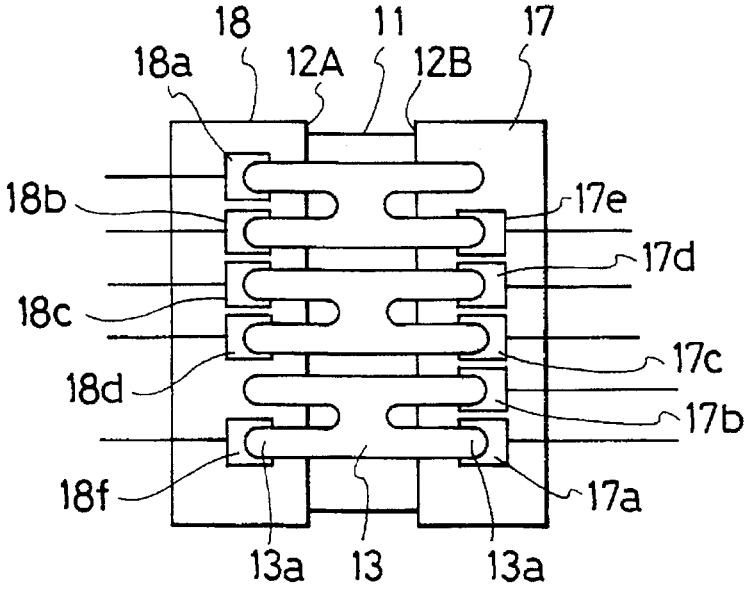
FIG. 10B is an illustrative plan view showing the electrical connection between the two mated connectors and the joint connector of the present invention when connected erroneously.

In the joint connector 11 constructed as described above, when two mated connectors 17 and 18 are inserted into the first and second joint openings 12A and 12B of the joint connector 11, as shown in FIG. 9, it is possible to obtain a predetermined electrical connection between the two mated connectors 17 and 18 through the joint connector 11. Further, FIGS. 10A and 10B show the electrical connection obtained when the two (first and second) mated connectors 17 and 18 are inserted into the connector housing 12 of the joint connector 11 in two opposite ways. In more detail, in FIG. 10A, the first mated connector 17 is inserted into the first joint opening 12A and a second mated connector 18 is inserted into the second joint opening 12B. In this case, the conduction relationship between the terminal portions 17*a* to 17*e* of the first mated connector 17 and the terminal portions 18*a* to 18*d* and 18*f* of the second mated connector 18 are as follows:

17*a*=17*b*=18*f*

17*c*=17*d*=18*c*=18*d*

17*e*=18*a*=18*b* where "=" indicates the conduction between both the right and left sides, and each terminal end portion is shown by only the reference numerals (the terminal portions are denoted in the alphabetical order from the upper left side to the lower left side and further lower right side to the upper right side in FIG. 10A.

On the other hand, in FIG. 10B, the first mated connector 17 is inserted into the second joint opening 12B and a second mated connector 18 is inserted into the first joint opening 12A. In this case, the conduction relationship between the terminal portions 17*a* to 17*e* of the first mated connector 17 and the terminal portions 18*a* to 18*d* and 18*f* of the second mated connector 18 are as follows:

17*a*=17*b*=18*f*

17*c*=17*d*=18*c*=18*d*

17*e*=18*a*=18*b*

Accordingly, whenever the mated connectors 17 and 18 are inserted into either of the joint openings 12A and 12B, it is possible to obtain the same electric conduction conditions. In other words, even when the two mated connectors 17 and 18 are inserted into the joint connector 11 erroneously in the opposite way, it is possible to obtain the same conduction results, so that no problem arises. In addition, it is possible to standardize the types or models of the mated connectors. Further, since the bus bars 13 are symmetrical in both shape and arrangement when they are insertion-molded together with the connector housing 11, the shrinkage and distortion of resin (material of the connector housing 12) are uniform, so that the positional precision of the branch terminal portions 13*a* can be improved.

Figure 11A:
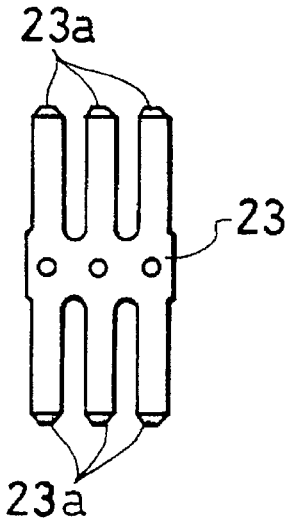
FIG. 11A is a plan view showing a bus bar used for another embodiment of the present invention.
Figure 11B:
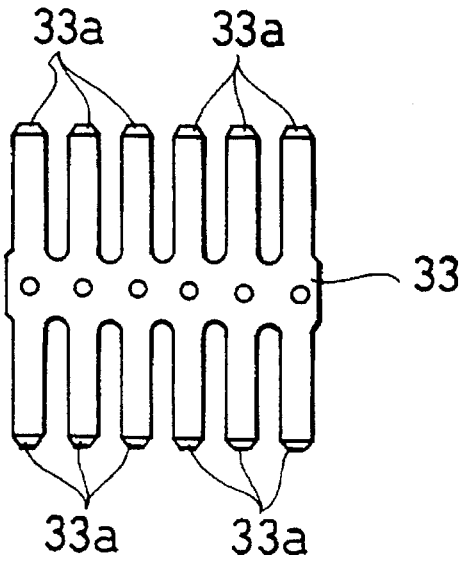
FIG. 11B is a plan view showing a bus bar used for still another embodiment of the present invention.

Further, in the above-mentioned embodiment, the bus bar 13 is of a four-pin type such that the two branch terminal portions 13*a* extend on both sides thereof, respectively as shown in FIG. 6. Without being limited thereto, however, it is also possible to form the bus bar with more than four pins. FIG. 11A shows a bus bar 23 of a six-pin type, which is formed with three branch terminal portions 23*a* extending on both sides thereof, respectively. FIG. 11B shows a bus bar 33 of a 12-pin type, which is formed with six branch terminal portions 33*a* extending on both sides thereof, respectively.

Figure 12A:
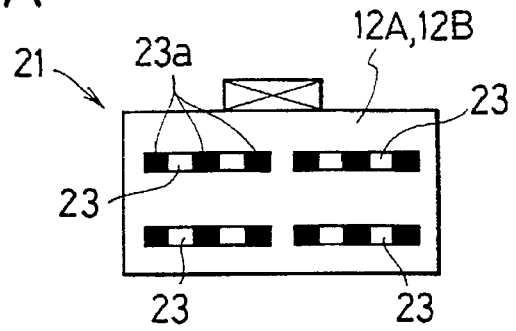
Figure 12B:
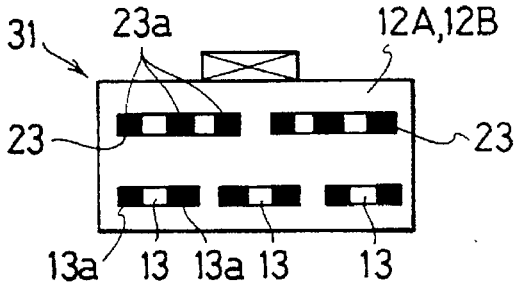
Figure 12C:
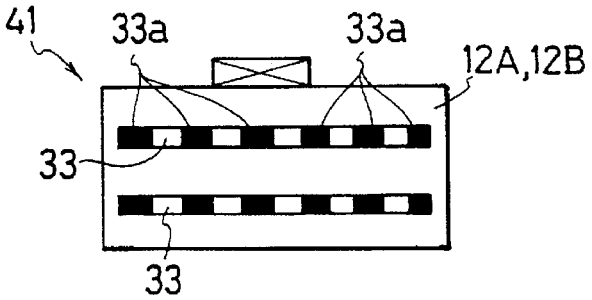
Figure 12D:
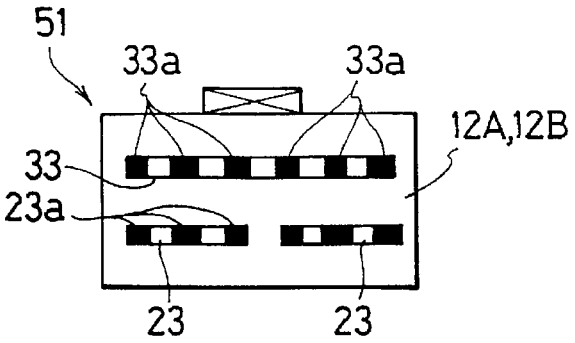

FIGS. 12A to D show other embodiments of the joint connectors 21, 31, 41 and 51 in which the above-mentioned three types of the bus bars 13, 23 and 33 are combined with each other appropriately. In more detail, FIG. 12A shows a joint connector 21 in which two 6-pin type bus bars 23 are arranged on both upper and lower sides thereof, respectively. FIG. 12B shows a joint connector 31 in which two 6-pin type bus bars 23 are arranged on the upper side thereof and three 4-pin type bus bars 13 are arranged on the lower side thereof. FIG. 12C shows a joint connector 41 in which one 12-pin type bus bar 33 is arranged on both upper and lower sides thereof, respectively. FIG. 12D shows a joint connector 51 in which one 12-pin type bus bar 33 is arranged on the upper side thereof and two 6-pin type bus bars 23 are arranged on the lower side thereof.

In any embodiments shown in FIGS. 12A to D, the respective branch terminal portions 13*a*, 23*a* and 33*a* of the bus bars 13, 23 and 33 are arranged in symmetrical positional relationship with respect to each other, and therefore the same electrical conduction conditions can be established on both the joint openings 12A and 12B of the joint connector. Accordingly, whenever the mated connectors 17 and 18 are inserted into any of the joint openings 12A and 12B, it is possible to obtain the same electric conduction conditions.

In the above-mentioned embodiments, it is possible to freely change the combinations of the embodiments and also to change the number of pins of the bus bars. Further, the present invention can be applied to any of the male and female connectors.

An example of the joint connector thus constructed and fixed to a vehicle body or a vehicle parts will be described hereinbelow.

Figure 13A:
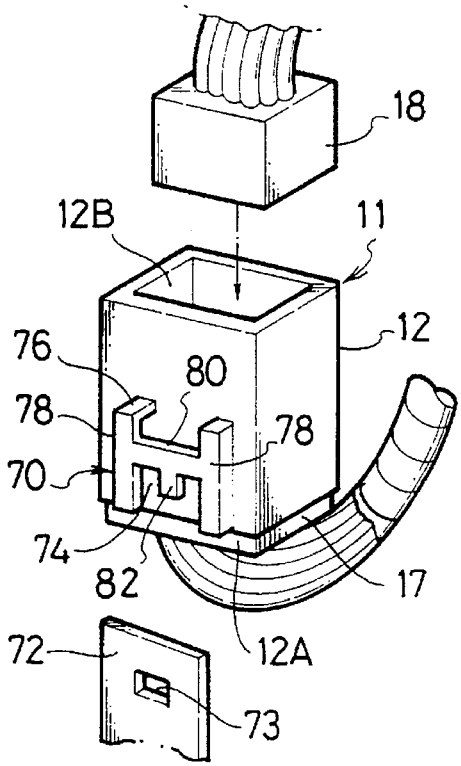
FIGS. 13A and B are perspective views showing an embodiment of the joint connector having a single-side slide engage portion according to the present invention, in which 13A shows the status where the joint connector is mounted in the correct direction.
Figure 13B:
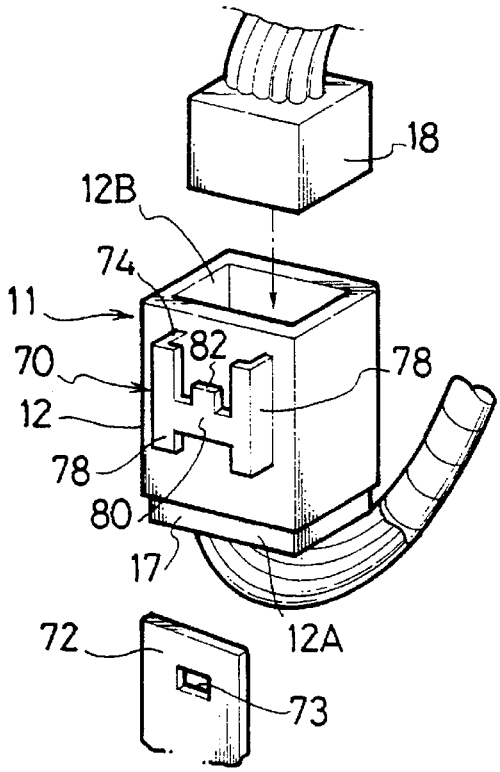
FIG. 13B shows the status where the joint connector in mounted in the incorrect direction.

In general, the joint connector is fixed to a vehicle body by use of an appropriate mounting member as shown in FIGS. 13A and 13B, in which the joint connector 11 is fixed to a vehicle body with a plate-shaped mounting member (bracket) by way of example.

FIGS. 13A and B show an example in which a one-side slide engage portion 70 is formed on an outer side surface of the connector housing 12 of the joint connector 11, in which 72 denotes a plate-shaped mounting bracket.

Figure 14:
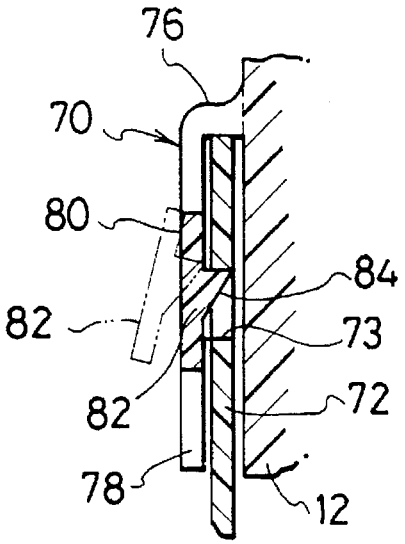
FIG. 14 is a cross-sectional view showing a correct insertion of a mounting member into the slide engage portion.

The slide engage portion 70 is formed with a slide opening 74 into which the mounting bracket 72 can be inserted, and a stopper wall 76 for determining a positional limit of inserted mounting bracket 72. The slide opening 74 is formed on the side opposite to the stopper wall 76. On both the sides (in the transverse direction in FIG. 13A) of the slide opening 74, a pair of right and left guide rails 78 are formed to guide the mounting bracket 72. Further, at the midway portion of the of the guide rails 78, a link plate 80 is formed between the guide rails 78 and and further the link plate 80 is formed with a deformable plate-shaped arm 82 at the middle portion thereof. As shown in FIG. 14, the deformable plate-shaped arm 82 is formed with an engage projection 84. The mounting bracket 72 is formed with an engage hole 73. Therefore, when the mounting bracket 72 is inserted into the slide engage portion 70, since the mounting bracket 72 is brought into contact with the engage projection 84, the deformable arm 82 is deflected until the engage projection 84 of the deformable arm 82 is engaged with the engage hole 73 of the mounting bracket 72 to fix the joint connector 11 to the mounting bracket 72, that is, onto the vehicle.

In the above-mentioned one-side slide engage portion 70, the slide opening 74 is formed only on one side of the first joint opening 12A of the connector housing 12. Therefore, when the mounting bracket 72 is inserted into the slide opening 74 of the slide engage portion 70 as shown in FIG. 13A, it is possible to engage the joint connector 11 with the mounting bracket 72.

In the joint connector 11 having the one-side slide engage portion 70, however, since the mounting bracket 72 can be engaged with the slide engage opening 70 only from one side, when the direction of the mounting bracket 72 matches the direction of the slide engage portion 70 as shown in FIG. 13A, it is possible to engage both with each other. However, when the direction of the slide engage portion 70 does not match the direction of the mounting bracket 72 as shown in FIG. 13B, it is impossible to engage them. Of course, when the joint connector 11 is reversed as shown in FIG. 13B, although both connectors 17, 18 can be engaged, in general it is not preferable or possible to reverse the direction of the wire harness or to rejoin the mated connector with the joint connector in the opposite direction, because the connection sequence or orientation of the wire harness is reversed or disoriented.

That is, in the example shown in FIG. 13B, under the conditions that the first mated connector 17 has been connected to the first joint opening 12A of the joint connector 11, it is necessary to locate the joint connector 11 in such a way that the second joint opening 12B is directed upward for connection of the joint connector 11 with the second mated connector 18, it is not preferable or possible to reverse the joint connector 11 so that the joint connector 11 can be fixed to the mounting bracket 72.

Figure 15:
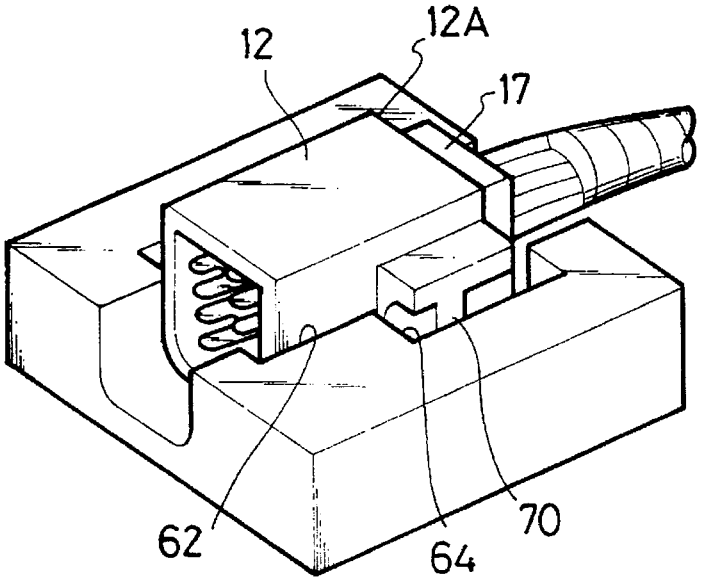
FIG. 15 is a perspective view showing the joint connector fitted to a jig to determine a correct direction.

Accordingly, it is necessary to determine previously that one of the mated connectors 17 and 18 must be connected one of the joint openings 12A and 12B, in order to prevent the direction of the slide engage portion 70 from being reversed. For this purpose, it is possible to use a jig 60 as shown in FIG. 15 to determine the direction of the connector housing 12 previously. In more detail, the jig 60 is formed with a recessed portion 62 (into which the connector housing 12 can be fitted) and further a locating recessed portion 64 (into which the slide engage portion 70 is fitted) is formed at a part of the recessed portion 62. Further, the first mated connector 17 must be connected to the joint opening 12A near the slide engage portion 70. In accordance with the above-mentioned procedure, it is possible to match the direction of the slide engage portion 70 with the joint opening 12A into which the mated connector 17 is connected.

However, it is not preferable to use the jig 60 to determine the direction of the joint connector 11, according to the present invention, because the feature of the joint connector according to the present invention is that the mated connectors 17 and 18 can be connected to either of the joint openings 12A and 12B of the joint connector 12.

Figure 16:
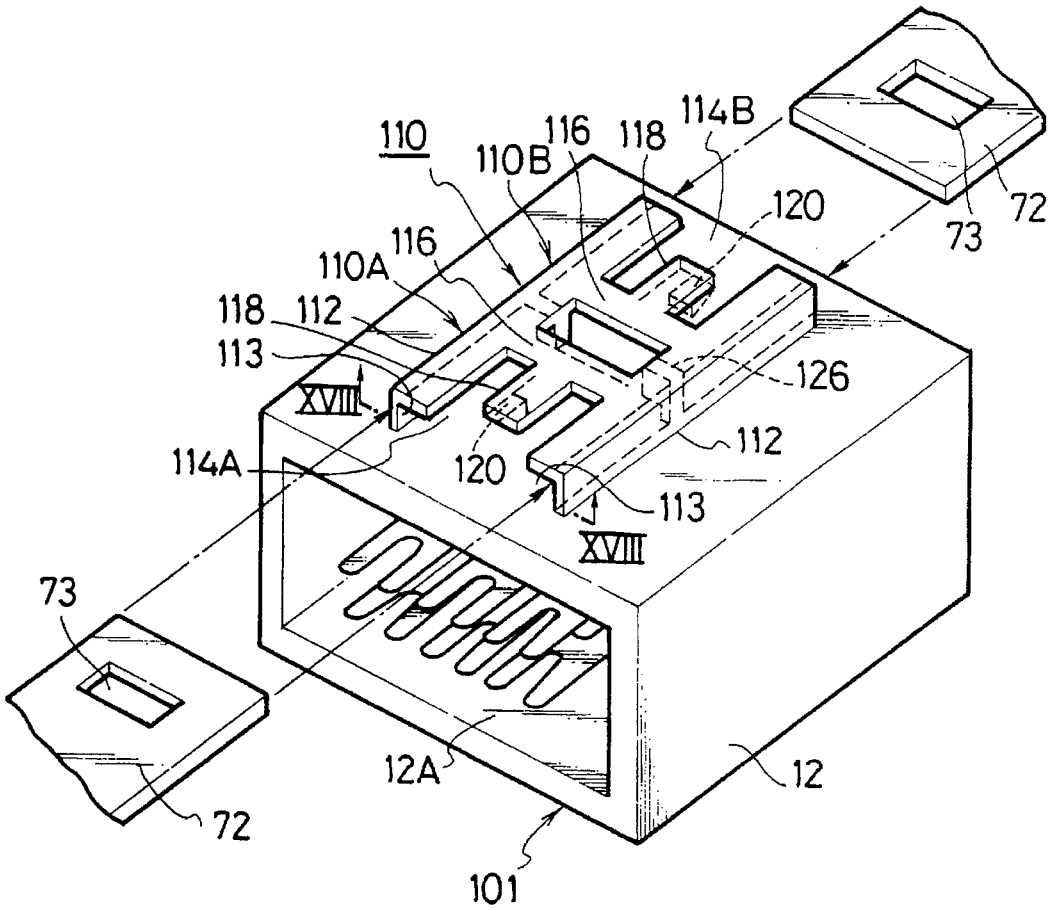
FIG. 16 is a perspective view showing another embodiment of the joint connector having a double-sided slide engage portion according to the present invention.

To overcome this problem, the joint connector 101 according to the present invention is characterized in that the connector housing 12 is formed integral with (molded together with) double-sided slide engage portion 110 on the outer side surface thereof, so that the mounting bracket 72 can be engaged with the slide engage portion 110 from either side of the joint connector 101, as shown in FIG. 16.

In more detail, the double-sided slide engage portion 110 of the joint connector according to the present invention is provided with a first slide engage portion 110A engaged with the mounting bracket 72 on one side of the first joint opening 12A of the joint housing 12 and a second slide engage portion 110B engaged with the mounting bracket 72 on the other side of the second joint opening 12B of the joint housing 12, in symmetry on both sides of the first and second joint opening (12A and 12B) sides, so that the mounting bracket 72 can be engaged with either one of the first and second engage portions 110A and 110B of the joint connector.

The above-mentioned structure will be described in further detail hereinbelow.

The first slide engage portion 110A and the second slide engage portion 110B are formed integral with each other for improvement of moldability. That is, these two first and second slide engage portions 110A and 110B are formed with a pair of guide rails 112 extending from the first joint opening 12A to the second joint opening 12B, as shown in FIG. 16. Each of these guide rails 112 is formed into an L-shape in cross section so that two slide grooves 113 can be formed between these guide rails 112 and the connector housing 12. The side edge of the mounting bracket 72 can be slid along these two slide grooves 113.

Between both ends of a pair of the guide rails 112, a slide opening 114A of the first slide engage portion 110A and a slide opening 114B of the second slide engage portion lib are formed so as to be directed in the same directions of the joint openings 12A and 12B of the connector housing 12, respectively. Therefore, the mounting bracket 72 can be inserted into either of the slide openings 114A and 114B of the two slide engage portions 110A and 110B of the joint connector, respectively.

Near the middle portion of both the guide rails 112 in the front and rear direction, a link plate 116 of the first slide engage portion 110A and another link plate 116 of the second slide engage portion 110B are formed spaced from each other. Each of these link plates 116 is formed as a deformable (distortable) narrow-width plate. These link plates 116 are formed integral with both the guide rails 12 on both outer ends thereof.

Further, each link plate 116 is formed integral with a plate-shaped deformable (bendable) arm 118 extending outward toward to each slide opening 114A or 114B. The free end of this deformable arm 118 can be or deflected in combination with a deformation of the link plate 116. This deformable arm 118 is formed with an engage projection 120 on an inner surface of a free end thereof.

Figure 17:
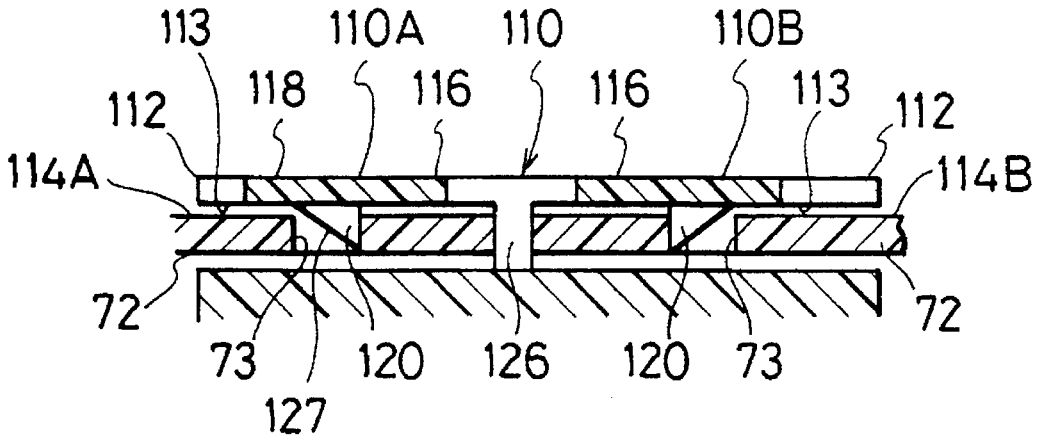
FIG. 17 is a cross-sectional view showing the double-sided slide engage portion of the joint connector according to the present invention shown in FIG. 16.

When the mounting bracket 72 is inserted into either of the slide opening ilia or 111B of the slide engage portions 110A and 110B, this engage projection 120 is engaged with an engage hole 73 formed in the mounting bracket 72 for prevention of removal of the joint connector 101 from the mounting plate 72. Further, as shown in FIG. 17, the engage projection 120 of the deformable arm 118 is formed with a sloped surface portion 127, respectively so as to be sloped down toward the slide opening 114A or 114B. Therefore, when the mounting bracket 72 is inserted into the respective slide opening 114A or 114B, the deformable arm 118 is deformed gradually outward.

Figure 18:
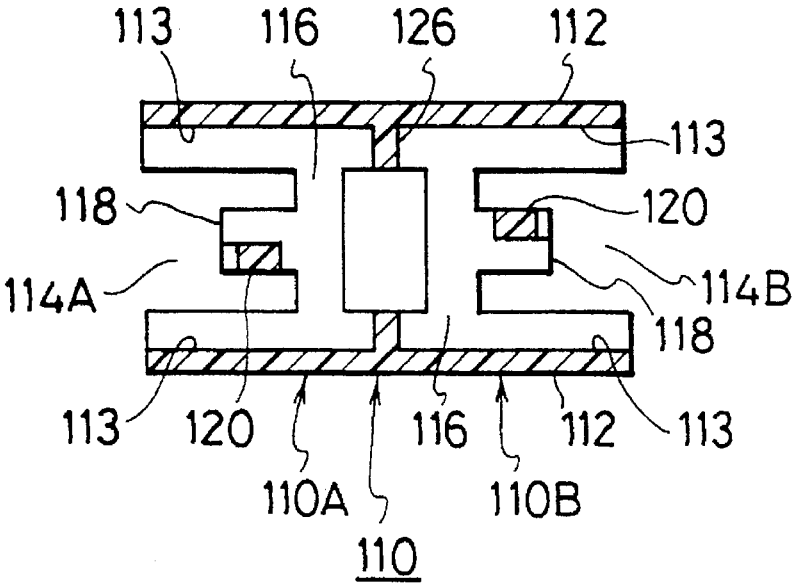
FIG. 18 is a cross-sectional view taken along the line XVIII—XVIII in FIG. 16.

Further, as shown in FIG. 18, the engage projection 120 of the first slide engage portion 110A and the engage projection 120 of the second slide engage portion 110B are formed offset from each other without being overlapped with each other when seen from the slide opening (114A or 114B) side. This is because the two engage projections 120 can be removed easily from a molding die after having been molded.

Further, at each middle portion of the guide rails 112, a stopper wall 126 is formed to determine the limit of the sliding movement of the mounting bracket 72. These two stopper walls 126 are formed integral with the two guide rails 112, respectively. These stopper walls 126 are also formed at such appropriate positions as to be removed easily from the molding die.

The function of the slide engage portions 110A and 110B of the joint connector according to the present invention will be described hereinbelow.

When the mounting bracket 72 is inserted into either one of the slide openings 114A and 114B of the first and second slide engage portions 110A and 110B, the mounting bracket 72 is inserted inwardly and is guided along the two guide rails 112. Since the mounting bracket 72 is brought into contact with the sloped surface 127 of the engage projection 120 formed with the deformable arm 118, the deformable arm 118 is deformed outward and thereby the engage projection 120 of the deformable arm 118 is engaged with the engage hole 73 formed in the mounting bracket 72. Under these conditions, the removal of the mounting bracket 72 from the slide engage portion 110A or 110B of the joint connector can be prevented. Further. in this case, since the mounting bracket 72 is stopped by the stopper wall 126, the slide movement of the mounting bracket 72 into the slide engage portion 110A or 110B can be limited, with the result that the joint connector 101 is fixedly engaged with the mounting bracket 72, as shown in FIG. 17. In FIG. 17, two mounting brackets 72 are engaged with the two slide engage portions 110A and 110B for illustrative purposes.

As described above, since the mounting bracket 72 can be engaged with either one of the slide engage portions 110A and 110B, it is unnecessary to take into account the mounting direction of the joint connector 101. Accordingly, it is unnecessary to use a jig to determine the direction of the joint connector 101, so that it is possible to make the best use of the invention such that the mated connectors 17 and 18 can be connected to the joint connector 101 from either side.

Further, in the above-mentioned embodiment, although the plate-shaped mounting bracket 72 is fixed to the vehicle body side, and the first and second slide engage portions 110A and 110B are both provided on the outer surfaces of the connector housing 12, it is of course possible to provide these elements in the opposite way. That is, it is also possible to provide the one-side slide engage portion (the same as the slide engage portion 70 as shown in FIG. 13A) on the vehicle body and to provide the mounting bracket having a double-sided mounting bracket 72 on the outer surface of the connector housing.

Further, without use of the slide engage portion 110A and 110B, it is also possible to provide a single engage portion engaged with a slidable mounting bracket 72.

As described above, in the joint connector according to the present invention, since the arrangement of the branched terminal portions (including the electric connection paths) can be equalized on both sides of the first and second joint openings of the connector housing, even if any one of the two mated connectors is connected to one of the joint openings of the joint connector, it is possible to obtain the same electrical connection conditions. Accordingly, any problem caused by erroneous connection of the mated connectors to the joint connector can be eliminated. Further, since the same mated connectors can be connected to either one of the joint openings of the joint connector, the mated connectors can be standardized, so that the cost thereof can be reduced. In addition, since the branched terminal portions of the bus bar are formed symmetrically toward both the first and second joint opening sides of the joint connector and further are arranged symmetrically when seen from either of the first and second joint opening sides of the connector housing, when the bus bars are insertion-molded together with the connector housing, the shrinkage and the distortion of the resin is uniform, so that the positional precision of the branched terminal portions can be improved.

Further, in the joint connector according to the present invention, since the connector housing can be engaged with the mounting member on side of the first and second joint openings of the joint connector, the mated connectors can be connected to the joint connector from side of the connector housing, without taking into account the direction of the connector housing of the joint connector relative to the direction of the mounting member.

What is claimed is:

1. An electrical joint connector, comprising: a connector housing formed with a first joint opening and joining with a first mated connector on a first end of said connector housing and a second joint opening joining with a second mated connector on a second end side of said connector housing, said connector housing having a first slide engage portion selectively engageable with a mounting member for fixing the joint connector to a support member and a second slide engage portion selectively engageable with the same mounting member for securing the joint connector to the same said support member, each of said first slide engage portion and said second slide engage portion comprising a pair of guide rails for guiding the mounting member, a deformable arm formed between said pair of guide rails, said arm being formed with an engage projection engageable with an engage hole formed in the mounting member, a stopper wall formed between said guide rails to limit insertion of the mounting member into each of said slide engage portions; and a bus bar housed in said connector housing and formed with a plurality of branch terminal portions extending toward the first and second end sides of said connector housing and arranged symmetrically from end to end as viewed from either of the first and second end sides of said connector housing.

2. The electrical joint connector of claim 1, wherein said pair of said guide rails of said first slide engage portion and said pair of said guide rails of said second slide engage portion are formed integral with each other.

3. The electrical joint connector of claim 1, wherein the engage projection of said first slide engage portion and the engage projection of said second slide engage portion are transversely offset from each other when viewed from the first and second end sides of said connector housing.

4. The electrical joint connector of claim 1, wherein said deformable arm is formed with a sloped portion such that when the mounting member is inserted into one of the slide engage portions, said mounting member engages said sloped portion and deflects said deformable arm.

5. An electrical joint connector, comprising: a connector housing formed with a first joint opening joined with a first mated connector on a first end side of said connector housing and a second joint opening joined with a second mated connector on a second end side of said connector housing, said first mated connector having a first plurality of terminals positioned with respect to one another in a first positional relationship, said second mated connector having a second plurality of terminals positioned with respect to one another in a second positional relationship different from said first positional relationship, and a plurality of discrete bus bars arranged in a horizontal plane in said connector housing, each of said bus bars having a first plurality of branch terminal portions extending toward the first end side of said of said connector housing, a second plurality of branch terminal portions extending toward the second end side of said connector housing, said first plurality of branch terminal portions being equal in number to said second plurality of branch terminal portions, said first plurality of branch terminal portions being positioned with respect to one another in a third positional relationship, said second plurality of branch terminal portions being positioned with respect to one another in a fourth positional relationship which is the same as the third positional relationship and different from at least one of the first and second positional relationships of the terminals of the first and second mated connectors whereby the same electrical connection between the first plurality of terminals and the second plurality of terminals results when the respective first or second mated connector is connected to the connector housing at either the first or the second joint opening.

6. The electrical joint connector of claim 5, wherein said bus bars are arranged in first and second vertically spaced horizontal planes.

7. The electrical joint connector of claim 6, including at least one bus bar in each of said first and second horizontal planes, each bus bar having at least two branch terminal portions extending toward said first end side and at least two branch terminal portions extending toward said second end side.

8. The electrical joint connector of claim 6, wherein the number of bus bars in the first horizontal plane is different from the number of bus bars in the second horizontal plane.

9. The electrical joint connector of claim 5, wherein said connector housing has a first slide engage portion oriented toward said first end side of said housing and selectively engageable with a mounting member for fixing the joint connector to a support and a second slide engage portion oriented toward said second end side of said housing and selectively engageable with said mounting member for fixing the joint connector to said support whereby said connector housing is engageable with said mounting member from either of said first and second end sides.

10. The electrical joint connector of claim 9, wherein each slide engage portion comprises a pair of guide rails for guiding the mounting member, a deformable arm formed between said pair of guide rails, said arm being formed with an engage projection, said mounting member being formed with an engage opening.

11. The electrical joint connector of claim 10, including a stopper wall formed between said guide rails to limit insertion of the mounting member into each slide engage portion.

12. The electrical joint connector of claim 10, wherein said guide rails of each slide engage portion are integrally formed with each other.

13. The electrical joint connector of claim 10, wherein the engage projections of said slide engage portions are transversely offset from each other when viewed from an end side of said connector housing.

14. The electrical joint connector of claim 10, wherein each engage projection is formed with a sloped portion such that when the mounting member is inserted into one of the slide engage portions, said mounting member engages said sloped portion and deflects said deformable arm.

* * * * *